US008925625B2

(12) United States Patent
Ninagawa et al.

(10) Patent No.: US 8,925,625 B2
(45) Date of Patent: Jan. 6, 2015

(54) HEAT EXCHANGER

(75) Inventors: Toshihide Ninagawa, Chita (JP); Tatsuo Ozaki, Okazaki (JP); Takahide Oohara, Okazaki (JP); Noriyuki Miyazaki, Nagoya (JP); Mitsuyoshi Saito, Hamamatsu (JP); U Ou, Anjo (JP); Norio Yoshida, Kariya (JP); Tetsuya Sakakibara, Toyohashi (JP); Kazuhiro Mitsukawa, Ichinomiya (JP)

(73) Assignee: Denso Corporation, Kariya (JP)

( * ) Notice: Subject to any disclaimer, the term of this patent is extended or adjusted under 35 U.S.C. 154(b) by 1345 days.

(21) Appl. No.: 12/515,392

(22) PCT Filed: Jul. 10, 2008

(86) PCT No.: PCT/JP2008/001850
§ 371 (c)(1),
(2), (4) Date: May 18, 2009

(87) PCT Pub. No.: WO2009/008172
PCT Pub. Date: Jan. 15, 2009

(65) Prior Publication Data

US 2010/0051252 A1 Mar. 4, 2010

(30) Foreign Application Priority Data

Jul. 11, 2007 (JP) ..... 2007-181965
Oct. 10, 2007 (JP) ..... 2007-264769
Feb. 28, 2008 (JP) ..... 2008-048444

(51) Int. Cl.
*F28D 7/00* (2006.01)
*F28F 9/22* (2006.01)
*F28F 9/02* (2006.01)

(52) U.S. Cl.
USPC ..... 165/159; 165/160; 165/161; 165/173; 165/174; 165/177

(58) Field of Classification Search
USPC ..... 165/159–161, 173–175, 177
See application file for complete search history.

(56) References Cited

U.S. PATENT DOCUMENTS 4,470,452 A * 9/1984 Rhodes ..... 165/153
4,570,700 A * 2/1986 Ohara et al. ..... 165/134.1

(Continued)

FOREIGN PATENT DOCUMENTS

JP 52-049859 12/1977
JP 58-000094 A 1/1983

(Continued)

OTHER PUBLICATIONS

Office action dated Aug. 2, 2011 in corresponding Japanese Application No. 2007-181965.

(Continued)

*Primary Examiner* — Mohammad M Ali
*Assistant Examiner* — Ian Soule
(74) *Attorney, Agent, or Firm* — Harness, Dickey & Pierce, PLC

(57) ABSTRACT

A heat exchanger has a flat tube (10) having a curved portion (13). A part of the curved portion (13) is formed by overlapping an outer rim (22) on an inner rim (21). The inner rim (21) has a small curvature region (102). The small curvature region (102) is inclined to a flat plate portion (11), and is defined by a radius larger than a difference between a half of a thickness of the flat tube (10) and a thickness of the outer rim (22). The small curvature region (102) is not beyond a center line (C1) in a thickness of the flat tube (10). The outer rim (22) extends beyond the center line (C1). The outer rim (22) has an end face (22*a*) placed on the small curvature region (102). The flat tube (10) has flared portions (15, 16) expanded at insertion holes (54).

16 Claims, 14 Drawing Sheets

(56) References Cited

U.S. PATENT DOCUMENTS

| | | | | |
|---|---|---|---|---|
| 4,805,693 | A * | 2/1989 | Flessate | 165/153 |
| 5,036,909 | A | 8/1991 | Whitehead et al. | |
| 5,185,925 | A * | 2/1993 | Ryan et al. | 29/890.049 |
| 5,947,365 | A | 9/1999 | Tanaka et al. | |
| 6,192,977 | B1 | 2/2001 | Dey et al. | |
| 6,739,386 | B2 * | 5/2004 | Lamich et al. | 165/175 |
| 7,117,936 | B2 | 10/2006 | Ohata et al. | |
| 2005/0121179 | A1 * | 6/2005 | Shibagaki et al. | 165/153 |
| 2006/0086491 | A1 | 4/2006 | Ueda | |
| 2007/0169926 | A1 * | 7/2007 | Watanabe et al. | 165/183 |

FOREIGN PATENT DOCUMENTS

| | | | |
|---|---|---|---|
| JP | 03-001097 | | 1/1991 |
| JP | 10-071463 | | 3/1998 |
| JP | 10-156462 | | 6/1998 |
| JP | 10-213385 | A | 8/1998 |
| JP | 11-183073 | | 7/1999 |
| JP | 2001-137989 | A | 5/2001 |
| JP | 2002-267380 | A | 9/2002 |
| JP | 2004-293988 | A | 10/2004 |
| JP | 2005-083700 | | 3/2005 |
| JP | 2005-121295 | A | 5/2005 |
| JP | 2005-121296 | A | 5/2005 |
| JP | 2005-300082 | A | 10/2005 |
| JP | 2006-118830 | A | 5/2006 |
| WO | WO-2004/005831 | A | 1/2004 |

OTHER PUBLICATIONS

Office action dated Jun. 7, 2011 in corresponding Japanese Application No. 2009-004160.

Office Action issued Dec. 4, 2012 in corresponding Japanese Application No. 2009-004160 with English translation.

Office Action dated Mar. 27, 2012 in corresponding Japanese Application No. 2009-004160 with English translation.

Office Action dated Apr. 13, 2010 in Chinese Application No. 200880003191 with English translation thereof.

* cited by examiner (a)

(b)

HEAT EXCHANGER

CROSS REFERENCE TO RELATED APPLICATIONS

This application is a 371 U.S. National Stage of International Application No. PCT/JP2008/001850, filed Jul. 10, 2008. This application is based on Japanese Patent Application No. 2007-181965 filed on Jul. 11, 2007, Japanese Patent Application No. 2007-264769 filed on Oct. 10, 2007, and Japanese Patent Application No. 2008-48444 filed on Feb. 28, 2008, the contents of which are incorporated herein by reference in its entirety.

TECHNICAL FIELD

The present invention relates to a heat exchanger having a flat tube.

BACKGROUND

A conventional flat tube for a heat exchanger is disclosed in JP2004-293988A. The flat tube is manufactured by laminating a first member and a second member in a manner that both width side rims of the first member are attached on outsides of both width side rims of the second member. The first member and the second member are manufactured by deforming metal plates into narrow gutter shapes. The manufactured flat tube has an outer surface on which stepped differences are formed by exposing end faces of the width side rims of the first member. On the width side rims of the first member, expanded portions expanded outwardly by a thickness of the plate are formed to fill up the stepped differences. Therefore, only on both longitudinal ends, the flat tube has a smooth outer profile where no stepped differences formed on an outer surface.

When manufacturing a heat exchanger, the longitudinal end of the flat tube is inserted into an insertion hole formed on a header and joined by brazing thereon. The both longitudinal ends of the flat tube may be inserted in a pair of headers. Before brazing, the longitudinal ends of the flat tube inserted in the tube insertion hole may be flared in order to improve contact condition between the flat tube and the header.

SUMMARY OF INVENTION

In the above described flat tube, the gap between the end of the first member and the expanded portion is enlarged after the longitudinal end is flared, therefore, it could lead to one problem in which a leakage defect on the heat exchanger becomes likely to occur since a quality of brazing between the flat tube and the header is lowered.

On the other hand, in the manufacturing process of the flat tube, a change of width of the plate, or a positional shift of both ends of the plates may be happened. In such a case, an overlapping portion on the flat tube may be shifted. As a result, it could lead to another problem in which a leakage defect on the heat exchanger becomes likely to occur since a quality of brazing between the flat tube and the header is lowered.

It is an object of the present invention to provide a heat exchanger having a flat tube which is able to suppress a change of outer profile caused by a shifting of the overlapping portion.

It is another object of the present invention to provide a heat exchanger where the development of leakage defect is reduced.

The present invention employs the following technical solutions in order to achieve the above described object.

In one embodiment of the invention, a heat exchanger is provided. The heat exchanger has a flat tube (10) made of a metal plate (10) that has two rims (21, 22) overlapped at a curved portion (13) that is placed on an end in a cross section. The flat tube (10) has the two rims (21, 22), one of which is an inner rim (21) placed inside, and the other one of which is an outer rim (22) placed outside the inner rim. The inner rim (21) is formed with a large curvature region and a small curvature region (102) having smaller curvature than that of the large curvature region. The outer rim (22) is formed with an end face placed on the small curvature region (102).

According to the embodiment above, if the overlapping portions are shifted for some reasons, it is possible to reduce a change of the outer profile. The arrangement is advantageous for both a heat exchanger having a flaring process and a heat exchanger without a flaring process. One advantage is to reduce a change of gap at a brazing portion to the header. As a result, it is possible to prevent a leakage at the brazing portion.

In the other embodiment of the invention, the large curvature region and the small curvature region (102) may be curved without inverting of curving direction from a flat plate portion (11) of the flat tube. As a result, it is possible to provide a simple profile on the inner rim compared to a complex profile where an inner rim is curved in different directions. This arrangement enables to use a simple manufacturing process.

In the other embodiment of the invention, the small curvature region (102) may be a flat surface.

In the other embodiment of the invention, the large curvature region may be placed closer to the distal end of the inner rim (21) than the small curvature region.

In the other embodiment of the invention, the small curvature region (482) may be placed closer to the distal end (410*c*) of the inner rim than the large curvature region (481).

In the other embodiment of the invention, a heat exchanger has the inner rim (21) and the outer rim (22) that are overlapped in an angular range equal to or more than 45 degrees. The small curvature region (102) is formed on a place that is not beyond a center line (C1) in a thickness direction of the flat tube (10). The outer rim (22) extends beyond the center line (C1).

According to the embodiment above, if the overlapping portions are shifted due to some reasons, it is possible to reduce a change of the outer profile. As a result, it is possible to reduce an increasing of gap between the outer surface of the flat tube and the insertion hole, and to prevent a leakage of the heat exchanger. The arrangement enables one rim (21) and the other rim (22) to slide easily therebetween, and therefore, both rims (21, 22) are likely to be easily deformed in a radial outside. Therefore, the embodiment is advantageous for the flaring process.

In the other embodiment of the invention, a heat exchanger includes a pair of headers (50, 60) having insertion holes (54) for being inserted both the longitudinal ends of the flat tube (10) therein. The flat tube (10) is made of a metal plate (10) that has two rims (21, 22) overlapped at a curved portion (13) on an end in the cross section. The flat tube (10) has a pair of flat plate portions (11, 12) and a pair of curved portions (13, 14). The flat tube (10) has a flared portion (15, 16) that is flared at the insertion hole (54). The small curvature region (102) is slanted with respect to the flat plate portion (11) and has a radius larger than a difference between a half of the thickness (d1) of the flat tube (10) and a thickness of the other rim (22).

According to the embodiment above, if the overlapping portions are shifted due to some reasons, it is possible to reduce a change of the outer profile. As a result, it is possible to reduce an increasing of gap between the outer surface of the flat tube and the insertion hole, and to prevent a leakage of the heat exchanger. The arrangement enables one rim (21) and the other rim (22) to slide easily therebetween, and therefore, both rims (21, 22) are likely to be easily deformed in a radial outside. Therefore, the embodiment is advantageous for the flaring process.

In the other embodiment of the invention, an opening shape of a part of the insertion hole (54) corresponding to the one of the curved portion (13) may be formed in a semi-circular shape. As a result, it is possible to improve a contact between the flat tube (10) and the header (50, 60), since it is possible to deform smoothly the outer rim (22) along the opening shape of the insertion hole (54) in the flaring process.

In the other embodiment of the invention, the thickness of the outer rim (22) may be gradually decreased toward the end face (22*a*) of the outer rim (22). As a result, it is possible to reduce a change of the outer profile.

In the other embodiment, the inner rim (21) may extend beyond the center line (C1). According to the embodiment, both the rims (21, 22) are urged to make narrow a gap therebetween by applying a pressurizing force from outside in the thickness direction of the flat tube (10) when assembling the plurality of tubes (10). Therefore, it is possible to make the both rims (21, 22) surely contact and to improve a quality of brazing of the flat tube (10).

In the other embodiment of the invention, the thickness of the inner rim (21) may be gradually decreased toward the end face (21*a*) of the inner rim (21). As a result, it is possible to perform the flaring process easily, since it is possible to reduce the stepped difference formed on an inner surface of the flat tube (10). In addition, it is possible to reduce a flow resistance in the flat tube (10), since it is possible to increase the inner cross sectional area of the flat tube (10).

In the other embodiment of the invention, the end face (22*a*) of the outer rim (22) and the outside surface (21*b*) of the inner rim (21) may define a facing angle (θ) in an acute angle. According to the embodiment, it is possible to even improve a quality of brazing between the flat tube (10) and the header (50, 60), since a filet of brazing material and a flux material are easily formed between the end face (22*a*) and the outside surface (21*b*).

In the other embodiment of the invention, the metal plate (20) may be made of a clad plate having a brazing material layer clad on at least one of sides.

The reference numbers with the parentheses in the above description indicates one example of correspondences to technical measures described in the embodiments below.

BRIEF DESCRIPTION OF DRAWINGS

Additional objects and advantages of the present invention will be more readily apparent from the following detailed description of preferred embodiments when taken together with the accompanying drawings. In which.

DESCRIPTION OF EMBODIMENTS

First Embodiment

Figure 1:
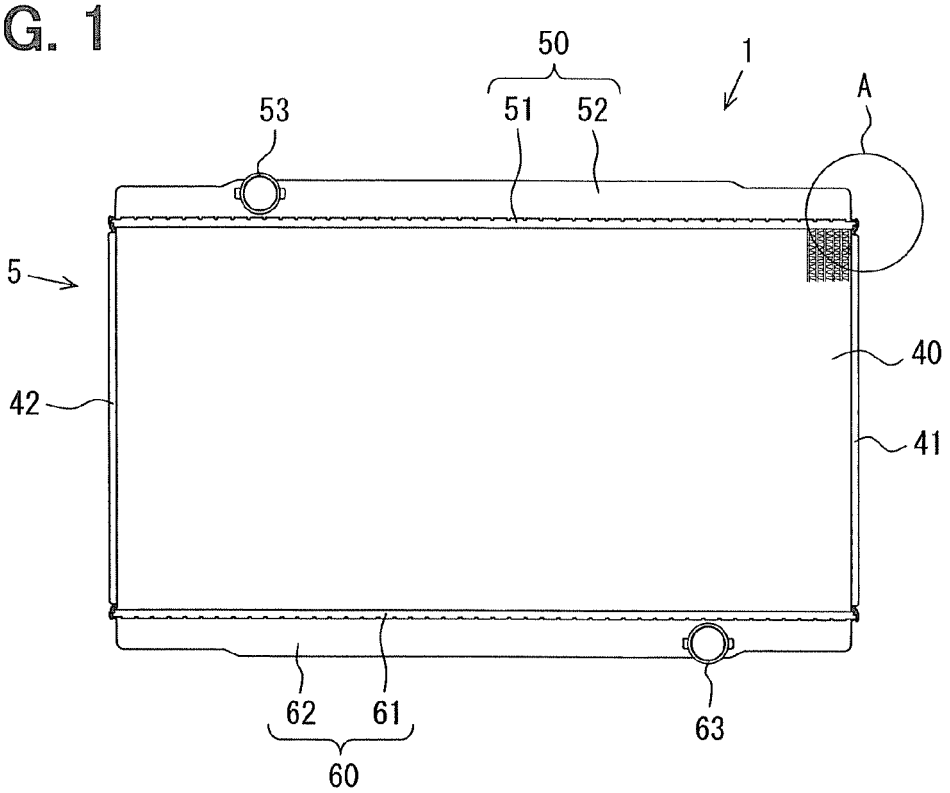
FIG. 1 shows an entire structure of a radiator according to a first embodiment of the invention, (a) of which shows a frontal view, and (b) of which shows a side view.
Figure 1:
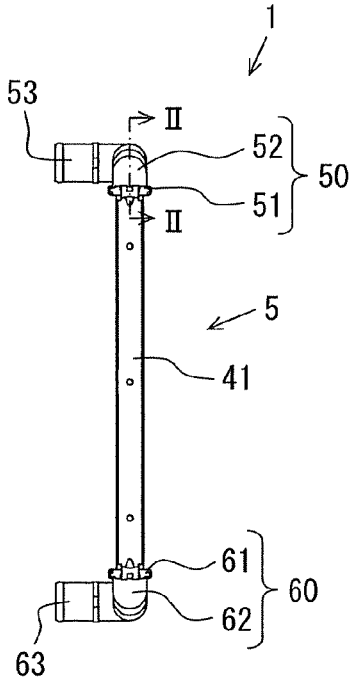
Figure 2:
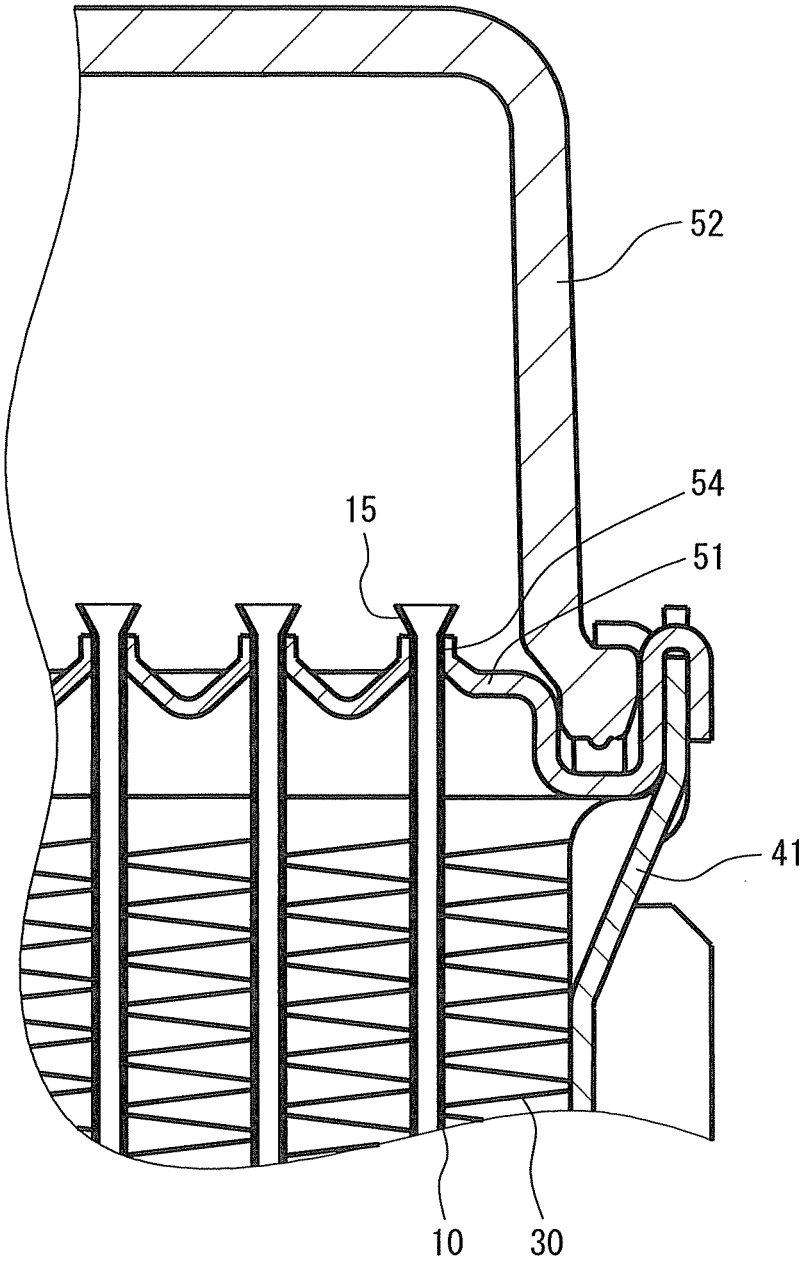
FIG. 2 is a partial sectional view of the radiator along the line II-II in FIG. 1 (*b*)
Figure 3:
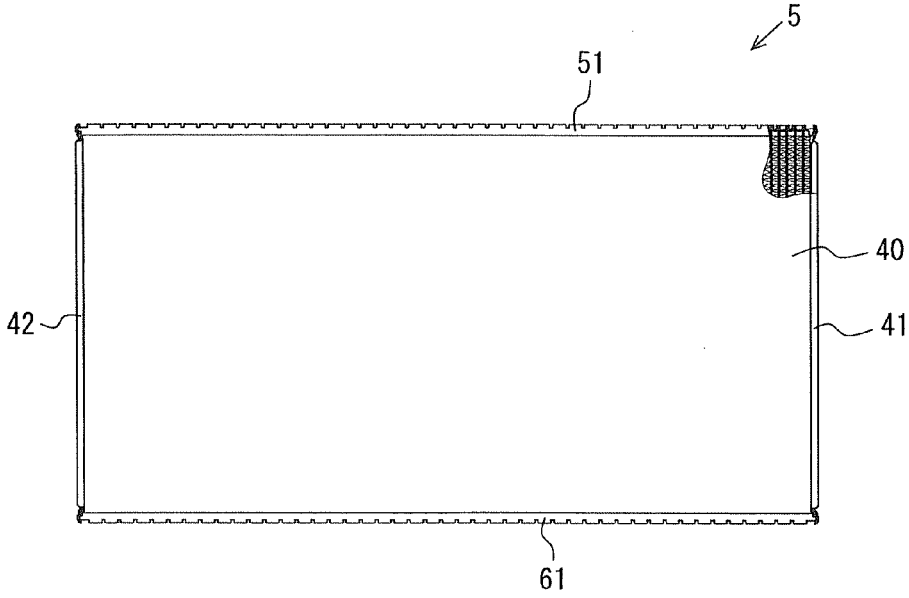
FIG. 3 is a frontal view of a core sub-assembly.

A first embodiment of the invention is described below with FIGS. 1-11. FIG. 1(*a*) is a frontal view showing an entire structure of a radiator 1 that is a heat exchanger of the embodiment. FIG. 1(*b*) is a side view of the radiator 1. FIG. 2 is a partial sectional view showing a part of A-section along the line II-II in FIG. 1(*b*). FIG. 3 is a frontal view showing a structure of core sub-assembly of the radiator 1. Up and down directions in FIG. 1(*a*), FIG. 1(*b*), FIG. 2 and FIG. 3 correspond to the vertical directions. The radiator 1 includes a core sub-assembly 5 and a pair of tanks 52, 62 as shown in FIG. 1(*a*), FIG. 1(*b*), FIG. 2 and FIG. 3. The core sub-assembly 5 is made of a plurality of components unitary joined by brazing. For example, the components are made of aluminum alloy. The pair of tanks 52, 62 is attached on the core sub-assembly 5. For example, the tanks are made of resin. The tank 52 is formed with an inlet 53 for introducing an engine coolant from the outside. The tank 62 is formed with an outlet 63 for flowing out the engine coolant to the outside.

The core sub-assembly 5 has a core 40 for performing heat exchange between the engine coolant and air. The core 40 has a structure in which a plurality of flat tubes 10 and a plurality of corrugated fins 30 are alternately stacked. The flat tube 10 through which the engine coolant flows is extending in the vertical direction. The corrugated fin 30 for increasing a heat exchanging area for the air is thermally connected with the flat tube 10. A pair of insert members for reinforcing mechanical strength of the core 40 is disposed on both outside ends of the core 40 in a stacking direction. The insert members may be called as side plates.

The core sub-assembly 5 further has a core plate 51 and a core plate 61. The core plate 51 is disposed on an upper end of the core 40 and provides an upper header 50 with the tank 52. The core plate 61 is disposed on a bottom end of the core 40 and provides a bottom header 60 with the tank 62.

Figure 4:
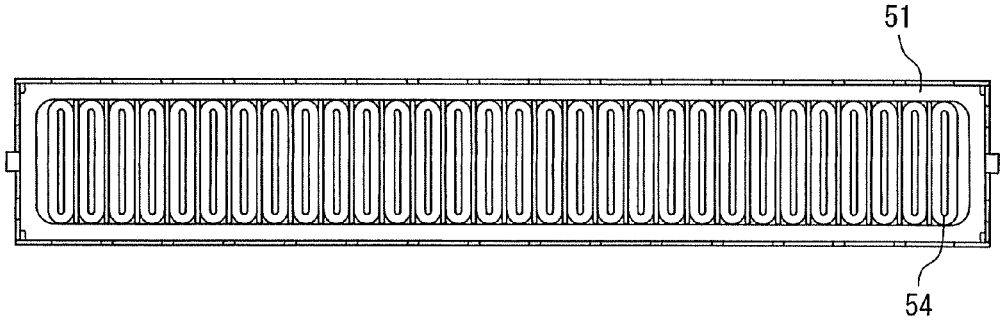
FIG. 4 is an upper view of a core plate.

FIG. 4 is an upper view showing a structure of the core plate 51. As shown in FIG. 4, the core plate 51 is formed with a plurality of insertion holes 54 for respectively receiving longitudinal ends of the flat tubes 10 stacked. The insertion hole 54 defines a flattened opening that may be a substantially elliptical shape. The insertion hole 54 has a pair of straight portions parallel to each other, and a pair of semi-circular portions. Each of the semi-circular portions defines a semi-circular shape being convex toward the outside and connects ends of the straight portions.

Figure 5:
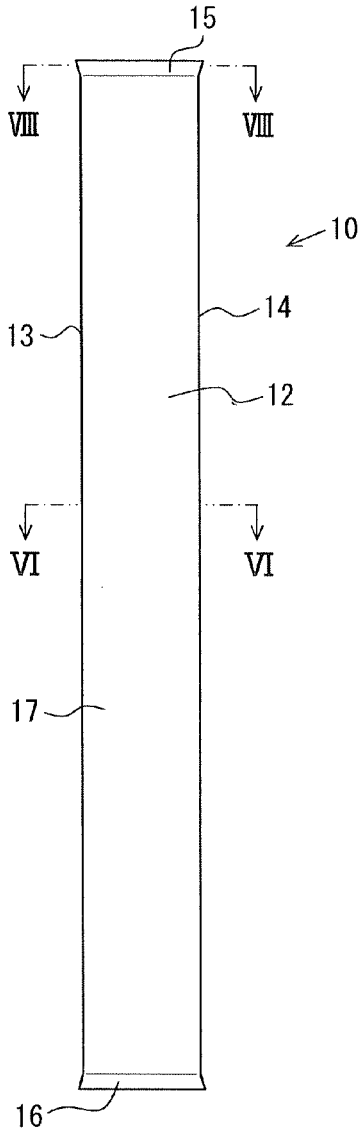
FIG. 5 is a frontal view of a flat tube viewing in a direction along a thickness.

FIG. 5 shows a structure of the flat tube 10 viewing in a thickness direction. As shown in FIG. 5, the flat tube 10 has a pipe portion 17 and flared portions 15 and 16. The pipe portion 17 is formed in a cylindrical shape having a substantially constant size in the longitudinal direction. Each of the flared portions 15 and 16 are formed on both longitudinal ends of the pipe portion 17 respectively. Each of the flared portions 15 and 16 is formed in a funnel shape that is expanded toward the edge in the longitudinal direction. The flared portions 15 and 16 are formed by flaring entire circumference of the both ends by using a flaring tool after inserting the longitudinal ends of the flat tube 10 into the insertion holes 54 respectively. By forming the flaring portions 15 and 16, the quality of brazing between the flat tube 10 and the core plate 51 is improved, since it is possible to improve contact condition and to reduce a gap between the flat tube 10 and the opening of the insertion hole 54.

Figure 6:
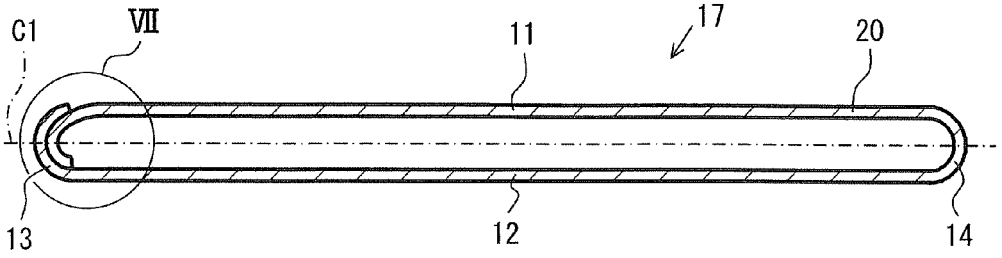
FIG. 6 is a sectional view of a pipe portion of the flat tube along the line VI-VI in FIG. 5.

FIG. 6 is a cross sectional view showing a structure of the pipe portion 17 of the flat tube 10 in a cross section indicated by the line VI-VI in FIG. 5. As shown in FIG. 6, the flat tube 10 defines a flat and substantially elliptical cross section. The flat tube 10 is made of a single metal plate 20 that has a layered structure, e.g., a three layered. For example, the metal plate 20 is a clad plate that has a brazing material layer, a core layer and a sacrificial material layer, all of which are made of aluminum alloys. The flat tube 10 is formed by bending the metal plate 20 in a single bending direction so that the brazing material layer, the core layer and the sacrificial material layer are disposed in this order from the radial outside.

The flat tube 10 has a pair of flat plate portions 11 and 12 opposing each other and extending in parallel, and a pair of curved portions 13 and 14. Each of the curved portions 13 and 14 defines a semi-cylindrical shape being convex toward the outside and connects ends of the flat plate portions 11 and 12. The flat tube 10 takes a maximum width at a position close to the center line C1.

Figure 7:
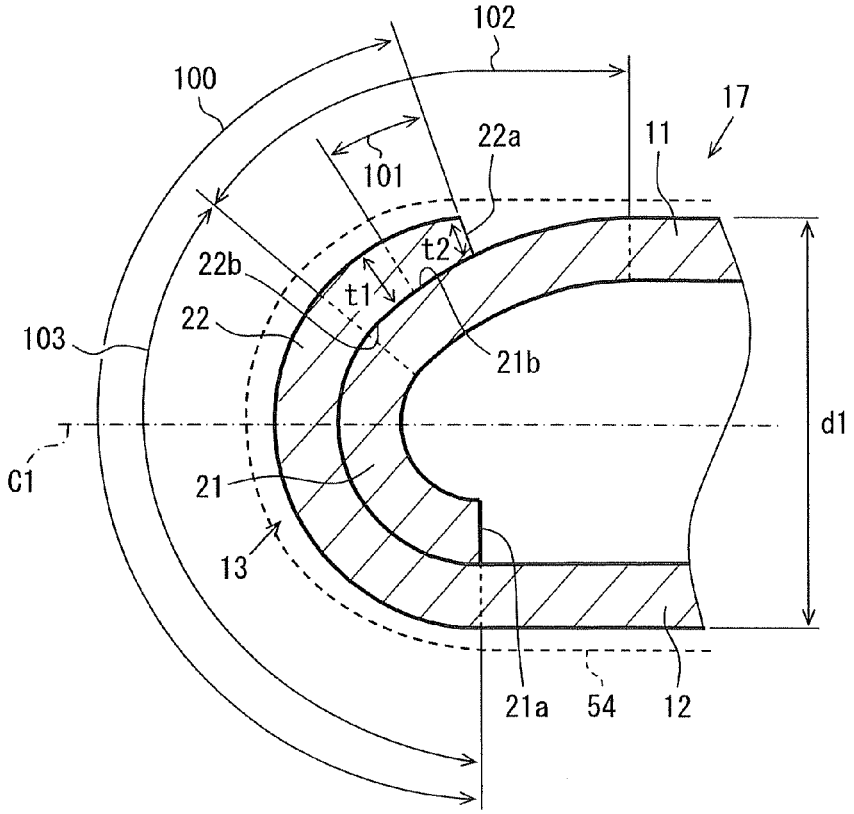
FIG. 7 is a sectional view of a portion VII in FIG. 6.

FIG. 7 is a cross sectional view showing a structure of a section indicated by VII in FIG. 6. In FIG. 7, an opening of the insertion hole 54 is indicated by a broken line. As shown in FIG. 7, the curved portion 13 has an overlapping region 100 on at least a part thereof. The overlapping region 100 is made of rims 21 and 22, one of which is placed inside as an inner rim 21, and the other of which is placed as an outer rim 22 on the outside of the inner rim 21. In the overlapping region 100, an inside surface 22*b* of the outer rim 22 and an outside surface 21*b* of the inner rim 21 are joined by brazing.

The outer rim 22 extends beyond the center line C1 along the outside surface 21*b* of the inner rim 21. The outer rim 22 has an end region 101 a thickness of which becomes gradually thinner toward the end face 22*a*. A thickness ratio between a thickness t1 in a region other than the end region 101 and the thickness t2 close to the end face 22*a* is set, for example, equal to or greater than 50%. However, there is a possibility to make it difficult to perform a forming process of the metal plate 20 if the thickness ratio is set too small. Therefore, it is preferable to set the thickness ratio in a range between 60% and 70% in consideration of deformability of the metal plate 20. Almost all area of the outer rim 22 is curved with a radius that is substantially the same as a half of a thickness d1 of the flat tube 10. Here, the thickness d1 is defined as a distance between the outside surface of the flat plate portion 11 and the outside surface of the flat plate portion 12.

The inner rim 21 extends beyond the center line C1 along the inside surface 22*b* of the outer rim 22. The inner rim 21 has an end face 21*a* that is placed on a position close to a boundary between the flat plate portion 12 and the curved portion 13. The inner rim 21 has a small curvature region 102 that is connected with the flat plate portion 12 in a continuous and smooth fashion. The small curvature region 102 is formed to extend and to occupy up to and not beyond the center line C1. The small curvature region 102 is slanted with respect to the flat plate portion 11 and has a relatively smaller curvature. In other words, the small curvature region 102 has a relatively large radius. The inner rim 21 further has a large curvature region 103 formed closer to the end face 21*a* as compared to the small curvature region 102. The large curvature region 103 is formed to extend beyond the center line C1. The large curvature region 103 has a curvature larger than that of the small curvature region 102. In other words, the large curvature region 103 has a radius smaller than that of the small curvature region 102.

The radius of the large curvature region 103 is substantially the same as a difference between a half of the thickness d1 of the flat tube 10 and a thickness t1 of the other rim 22. The radius of the small curvature region 102 is set larger than that of the large curvature region 103. The small curvature region 102 may include a flat plate part the curvature of which is 0 (zero) and the radius of which is infinity.

An end face 22*a* of the outer rim 22 is placed on the outside surface 21*b* of the small curvature region 102. The end face 22*a* and a part of the outside surface 21*b* close to the end face 22*a* define a substantially right angle.

Here, neither the inner rim 21 nor the outer rim 22 has a region where convexes inwardly, since the flat tube 10 is manufactured by deforming the metal plate 20 only in a single bending direction. As a result, both the small curvature region 102 and the large curvature region 103 are bent without inverting the bending direction from the flat plate portion 11 of the flat tube 10.

Figure 8:
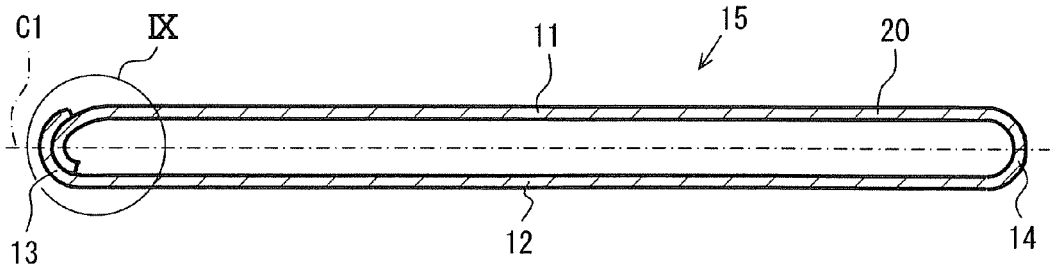
FIG. 8 is a sectional view of a flared portion of the flat tube along the line VIII-VIII in FIG. 5.
Figure 9:
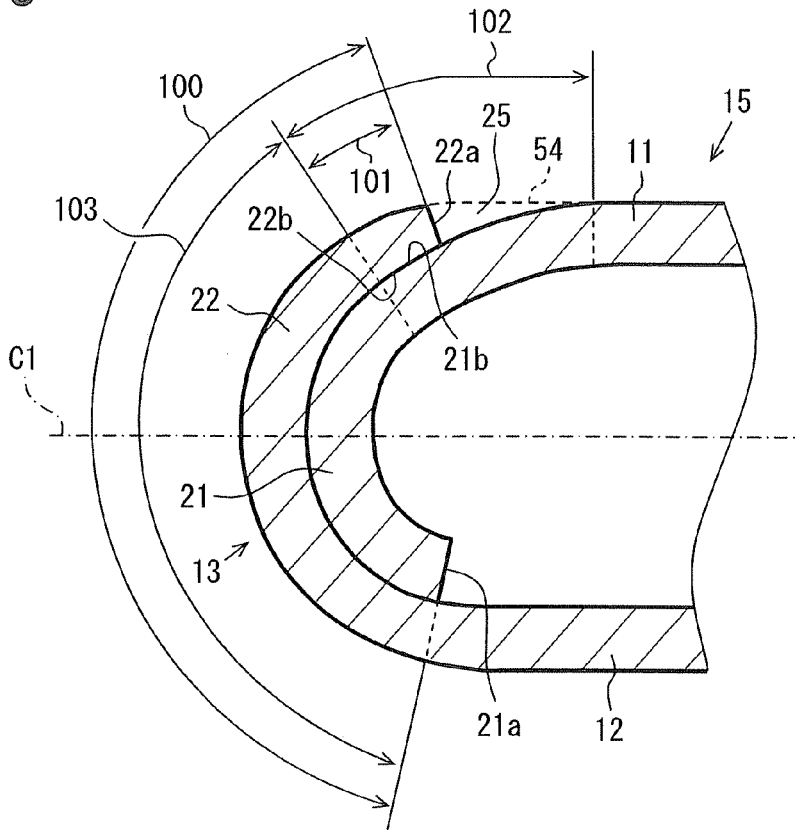
FIG. 9 is a sectional view of a portion IX in FIG. 8.

FIG. 8 is a cross sectional view showing a structure of the flared portion 15 of the flat tube 10 at a cross section indicated by VIII-VIII line in FIG. 5. FIG. 9 is a cross sectional view showing a structure of a part indicated by IX in FIG. 8. As shown in FIGS. 8 and 9, the flared portion 15 is expanded in a radial direction compare to the pipe portion 17 shown in FIGS. 6 and 7. Therefore, a cross sectional shape of the flared portion 15 of the flat tube 10 is deformed along a shape of the opening of the insertion hole 54. In the flared portion 15, the flat plate portions 11 and 12, the curved portion 13 and the curved portion 14, except for a gap portion 25 formed at a position close to the end face 22*a* of the outer rim 22, are configured to come in surely contact with an opening end of the insertion hole 54.

The overlapping region 100 becomes narrower at the flared portion 15 in comparison to the pipe portion 17, since the end face 21*a* of the inner rim 21 and the end face 22*a* of the outer rim 22 are formed to relatively approach each other by expanding the flat tube 10. Further, the small curvature region 102 also becomes narrower, since a part of the inner rim 21 closely attached on the outer rim 22 except for the end region 101 is deformed into a shape following an opening shape of the insertion hole 54 and the outer rim 22.

Next, a manufacturing process of the radiator 1 in this embodiment is described. First, a plurality of belt shaped metal plates 20 are manufactured by using a clad plate having a three-layered structure with a brazing material layer, a core layer and a sacrificial material layer. In this process, one end of the metal plates 20 is processed to gradually reduce the thickness toward the end face. Next, in a tube forming process, the metal plate 20 is deformed by bending process in a single direction to form a flat tube 10 that includes a pair of the flat plate portions 11 and 12 and a pair of the curved portions 13 and 14. In this process, the overlapping region 100 is formed on one of the curved portion 13 by overlapping the inner rim 21 and the outer rim 22 of the metal plate 20. In this process, the flat tube 10 is still not formed with the flared portion 15 and 16. Therefore, the flat tube 10 is formed in a cylindrical shape having a cross-sectional shape of the pipe portion 17 as shown in FIG. 6 and FIG. 7 along an entirely in a longitudinal direction. In other words, the inner rim 21 of the flat tube 10 has the small curvature region 102 along the entirely in the longitudinal direction. The end face 22*a* of the outer rim 22 is placed on the outside surface 21*b* of the small curvature region 102.

Then, in a core assembling process, an assembly of a core portion 40 is manufactured by alternately stacking the plurality of flat tubes 10 and the plurality of corrugated fins 30 formed in a separate manufacturing process. In the core assembling process, a predetermined compressing load is applied on the flat tubes 10 and the corrugated fins 30 from outsides along a thickness direction of the flat tubes 10.

Then, in a core plate assembling process, an assembly of a core sub-assembly 5 is manufactured by assembling core plates 51 and 61 on the core portion 40. In the core plate assembling process, both longitudinal ends of the flat tubes 10 are inserted in the plurality of insertion holes 54 formed on the core plates 51 and 61. As shown in FIG. 7, a narrow gap is formed between an outer surface of the flat tube 10 and an opening edge of the insertion hole 54, since flat tube 10 is formed slightly smaller in diameter than the insertion hole 54.

Then, in a flaring process, the flared portions 15 and 16 are formed by flaring the both longitudinal ends of the flat tubes 10 inserted in the insertion holes 54 in a funnel shape by using a flaring tool. A cross sectional shape of the flared portions 15 and 16 are deformed to follow an opening shape of the insertion holes 54 as shown in FIG. 9. As a result, it is possible to improve a contacting condition between the flat tubes 10 and the core plates 51 and 61. On the other hand, the cross sectional shape on the pipe portion 17 of the flat tube 10 before performing the flaring process is almost maintained during the process. The flaring tool has a cross sectional shape substantially similar to an inner surface of the flat tubes 10. In other words, the cross sectional shape of the flaring tool is substantially ellipse in its entirety, and has a recess corresponding to a step formed at the end face 21*a* of the inner rim 21.

Then, in a brazing process, the components are brazed each other by heating the assembly of the core sub-assembly 5 and melting the brazing material layer. In this process, the contacting condition between the flat tubes 10 and the core plates 51 and 61 is improved by the flared portions 15 and 16, therefore it is possible to reduce generating improper brazing portions.

Then, in a resin made tank assembling process, the tanks 52 and 62 both made of resin are assembled on the core sub-assembly 5. By performing the above mentioned process, the radiator 1 shown in FIG. 1 is manufactured.

According to the embodiment, the inner rim 21 of the flat tube 10 has the small curvature portion 102, and the end face 22*a* of the outer rim 22 is placed on the outside surface 21*b* of the small curvature region 102 before the flaring process. Therefore, it is possible to suppress a change of an outer profile even if a shifting appears on the overlapping portion for some reasons. In addition, the inner rim 21 and the outer rim 22 easily slide therebetween. Therefore, it is possible to easily deform the inner rim 21 and the outer rim 22 outwardly in the flaring process. It is possible to provide an improved contact condition between the outer peripheral surface of the flat tube 10 and the opening edge of the insertion hole 54 in the flaring process, and to minimizing the gap. As a result, it is possible to improve a quality of brazing between the flat tubes 10 and the core plates 51 and 61, and to reduce leakage defect of the radiator 1.

In the embodiment, the thickness of the end region 101 of the outer rim 22 is gradually reduced toward the end face 22*a*. It is possible to reduce a slant angle with respect to the flat plate portion 11 at the small curvature region 102 of the inner rim 21. Therefore, the inner rim 21 and the outer rim 22 are arranged to be easily deformed in the flaring process. Further, it is possible to make even smaller the gap portion 25 formed between the flat tube 10 and the opening edge of the insertion hole 54 after the flaring process, since the thickness at the end face 22*a* can be made thinner. As a result, it is possible to further improve the quality of brazing between the flat tubes 10 and the core plates 51 and 61.

In the embodiment, the outer rim 22 extends beyond the center line C1 where the flat tube 10 obtains a maximum width. Consequently, the outer rim 22 comes into a snap fitted condition on the inner rim 21 in the tube forming process. As a result, it is possible to prevent the joining portion between the inner rim 21 and the outer rim 22 from breaking even if the residual stress on the other curved portion 14 is removed by a high temperature in the brazing process.

In the embodiment, the inner rim 21 extends beyond the center line C1. This arrangement generates a force in a direction narrowing a gap between a portion of the inner rim 21 beyond the center line C1 and the outer rim 22, when the compressing load is applied on the flat tubes 10 from outside of the thickness direction in the core assembling process. Therefore, the contacting condition between the inner rim 21 and the outer rim 22 is improved, and it is possible to improve a quality of brazing at the curved portion 13 of the flat tube 10, and to reduce leakage defect of the radiator 1.

In the embodiment, each of the insertion holes 54 of the core plates 51 and 61 has a semi-circular shaped opening edge located on a position corresponding to the curved portion 13. Therefore, it is possible to smoothly deform the outer rim 22 along the opening edge of the insertion hole 54, and to improve the contacting condition between the outside surface of the outer rim 22 and the opening edge of the insertion hole 54.

In a known conventional arrangement of the flat tube, an inwardly formed depression with a depth corresponding to a thickness of the plate is formed on an inner rim at an overlapping region in order to reduce a stepped difference formed at an end face of an outer rim. According to the conventional arrangement of the flat tube, the tube is deformed by the flaring process in a direction widening a gap at the stepped difference. Therefore, a quality of brazing between the flat tube and core plates may be lowered. In addition, in such a flat tube, there may be a problem to increase a manufacturing cost due to a complex forming process for tubes, since a sharp and precision bending process is required for bending a metal plate.

On the contrary, according to the embodiment, the flat tube 10 has no depression, since the flat tube 10 is formed by bending the metal plate 20 in a single direction. As a result, it is possible to suppress decreasing of a quality of brazing, since no gap expands in the flaring process. In addition, in the embodiment, it is possible to simplify a manufacturing process of the flat tubes 10 and to reduce a manufacturing cost, since no sharp and precision bending process is required.

(Second Embodiment)

Figure 10:
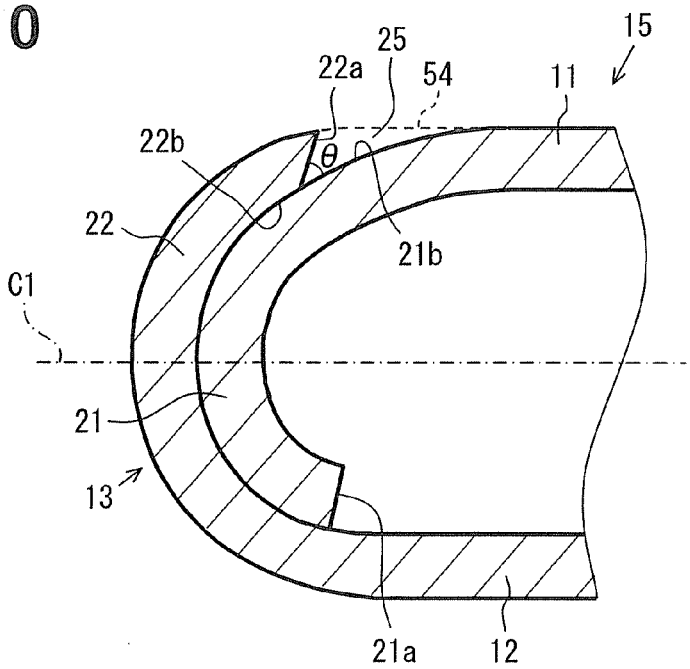
FIG. 10 is a sectional view of a flared portion of the flat tube according to a second embodiment of the invention.

FIG. 10 shows a second embodiment of a flat tube 10 that has an illustrated structure at a curved portion 13 on a flared portion 15. FIG. 10 shows a cross sectional view corresponding to FIG. 9. As shown in FIG. 10, an end face 22*a* of the outer rim 22 is formed in such a manner that an outside edge of the end face 22*a* is circumferentially protruded compared to an inside edge. This arrangement defines a facing angle θ between the end face 22*a* and an outside surface 21*b* of the inner rim 21 in an acute angle, i.e., θ<90 degrees. In a brazing process, a fillet of molten brazing material and flux is easily formed between the end face 22*a* and the outside surface 21*b*. Therefore, it is possible to improve a quality of brazing between the flat tube 10 and the core plates 51 and 61, and to prevent a leakage defect of the radiator 1.

In addition, the molten brazing material and flux easily enter a joining portion between the outer rim 22 and the inner rim 21 by a capillary effect, since a fillet is formed. Therefore, it is possible to improve a quality of brazing at the curved portion 13 of the flat tube 10, and to prevent a leakage defect of the flat tube 10.

(Third Embodiment)

Figure 11:
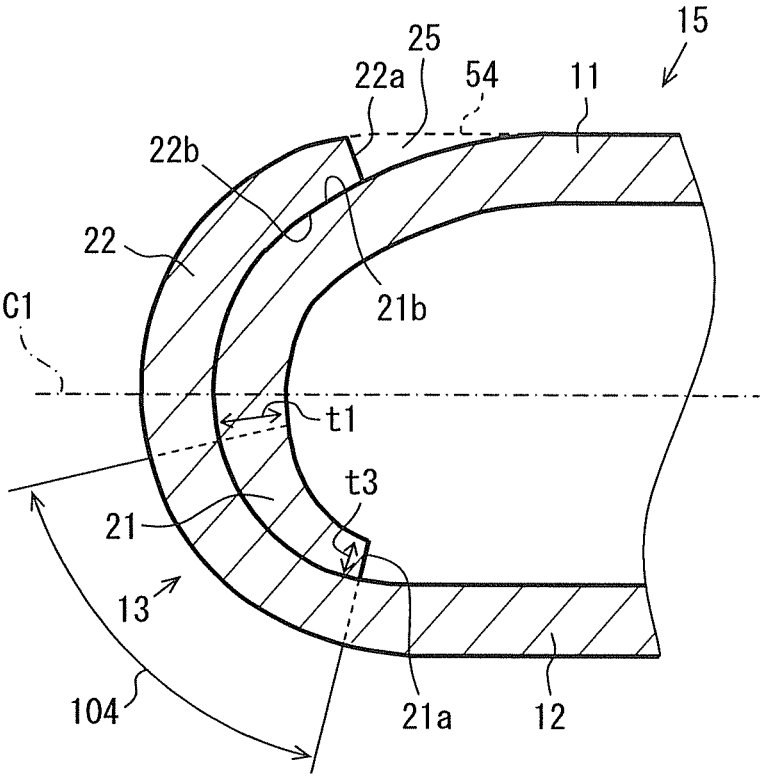
FIG. 11 is a sectional view of a flared portion of the flat tube according to a third embodiment of the invention.

FIG. 11 shows a third embodiment of a flat tube 10 that has an illustrated structure at a curved portion 13 on a flared portion 15. FIG. 11 shows a cross sectional view corresponding to FIG. 9. As shown in FIG. 11, a distal end region 104 of the inner rim 21 is formed to decrease a thickness thereof toward the end face 21*a*. For example, a thickness ratio between the thickness t1 at a region other than the distal end region 104 and the thickness t3 at a region close to the end face 21*a* is set equal to or more than 50%. The thickness t3 is smaller than the thickness t1. It is preferable that the thickness ratio is set around between 60% and 70% taking an ability of processing of the metal plate 20 in consideration, since it could be difficult to process the metal plate 20 if the thickness ratio is set too small.

According to the embodiment, a stepped difference on an inside surface of the flat tube 10 formed by the end face 21*a* is reduced. It is possible to make a recess formed on the flaring tool small or to remove the recess, and to perform the flaring process easily. Therefore, it is possible to simplify the manufacturing process of the heat exchanger, and to reduce a cost for manufacturing. In addition, it is possible to increase an inner cross sectional area of the flat tube 10, i.e., a cross sectional area of fluid passage, and to decrease a flow resistance in the flat tube 10.

(Fourth Embodiment)

Figure 12:
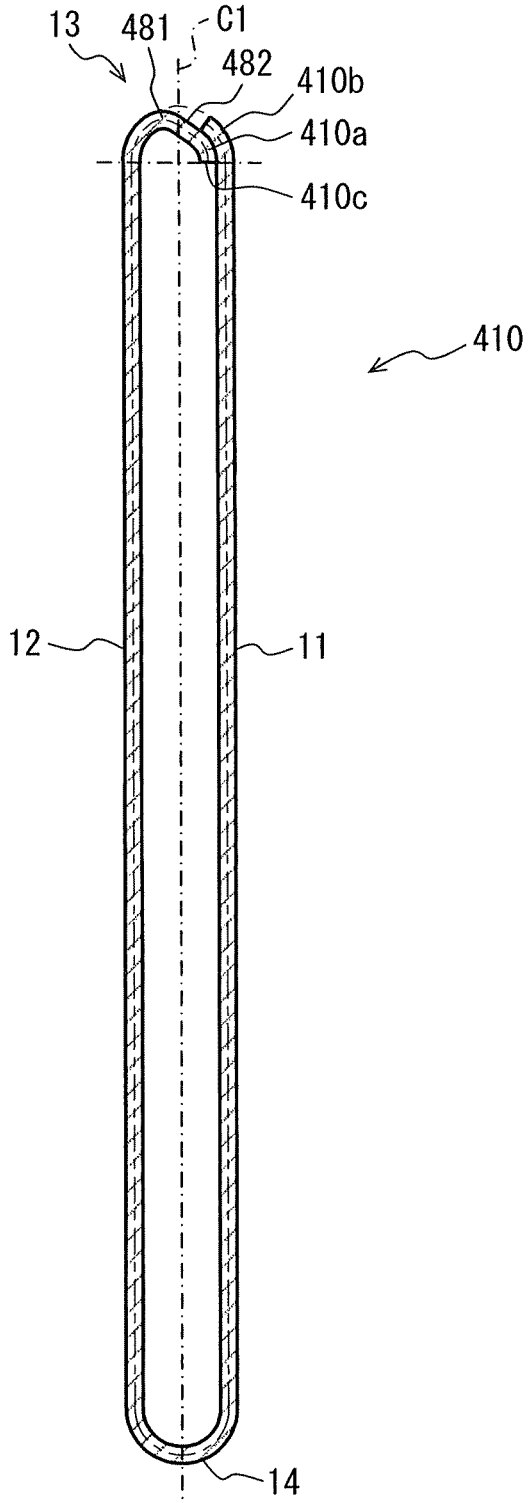
FIG. 12 is a sectional view of the flat tube according to a fourth embodiment of the invention.

Referring to FIG. 12, a fourth embodiment is explained. The rim 410*a* of the flat tube 410 has a large curvature region 481 that has a radius of curvature smaller than a half of the thickness of the flat tube 410. The large curvature region 481 may be called as a first region. To put is more precisely, the radius of the large curvature region 481 is a half of a difference between the thickness of the flat tube 410 and the thickness of the metal plate 20. The rim 410*a* has a flat region 482 that is almost flat. The flat region may be called as a second region. The large curvature region 481 is formed on a position that does not extend beyond the center line C1. The flat region 482 is formed on a distal end side in comparison to the large curvature region 481. The flat region 482 is located closer to a distal end 410*c* more than the large curvature region 481. The flat region 482 extends in a length substantially corresponding to a half of the thickness of the flat tube 410. The rim 410*b* is placed on the flat region 482 of the rim 410*a*. The rim 410*b* may be placed closer to a distal end than the flat region 482.

According to the embodiment, it is possible to make the cross sectional shape of the flat tube 410 similar to the elliptical shape. As a result, it is possible to reduce a gap between the flat tube 410 and the insertion hole. Further, it is possible to suppress a change of the outer profile in case that relative position of the end faces 410*c* and 410*b* are shifted in some reasons.

(Fifth Embodiment)

Figure 13:
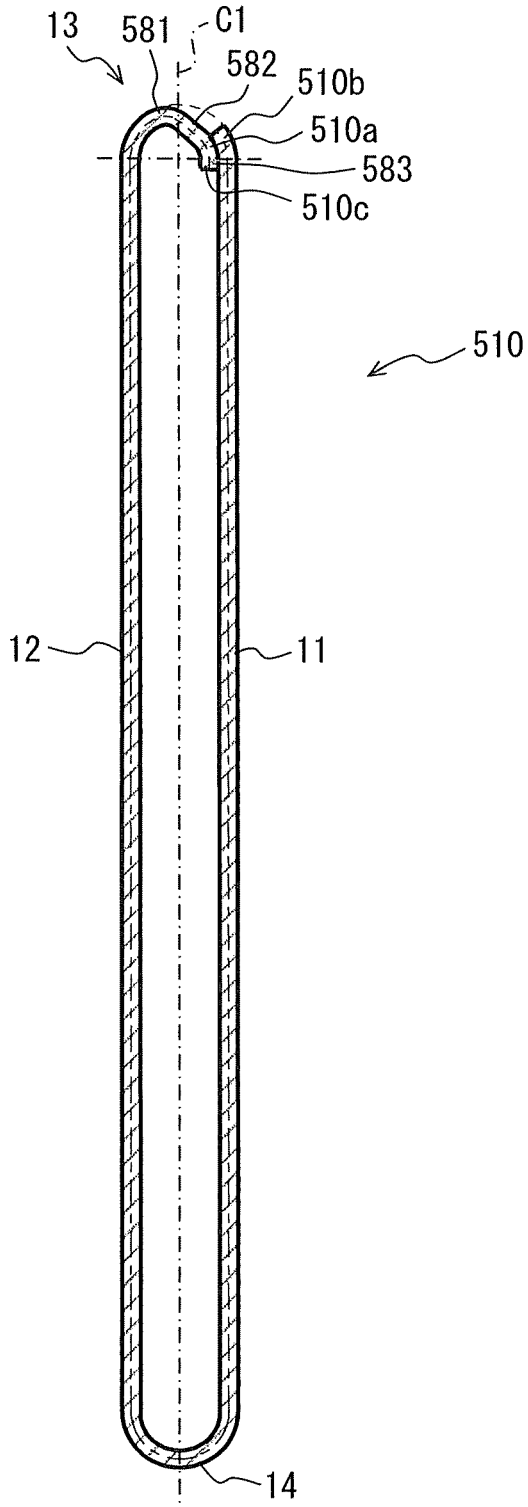
FIG. 13 is a sectional view of the flat tube according to a fifth embodiment of the invention.

Referring to FIG. 13, a fifth embodiment is explained. A large curvature portion 581 and a small curvature portion 582 are formed on a rim 510*a* of the flat tube 510. The rim 510*a* extends beyond the curved portion and even reaches to a flat plate portion 11. The rim 510*a* has an extended region 583 on a side of a distal end, i.e., an end face 510*c*. The extended region 583 is formed in a flat shape and is overlapped with the flat plate portion 11. Therefore, it is possible to increase a joining area between the rims 510*a* and 510*b*, and to improve a quality of brazing.

(Sixth Embodiment)

Figure 14:
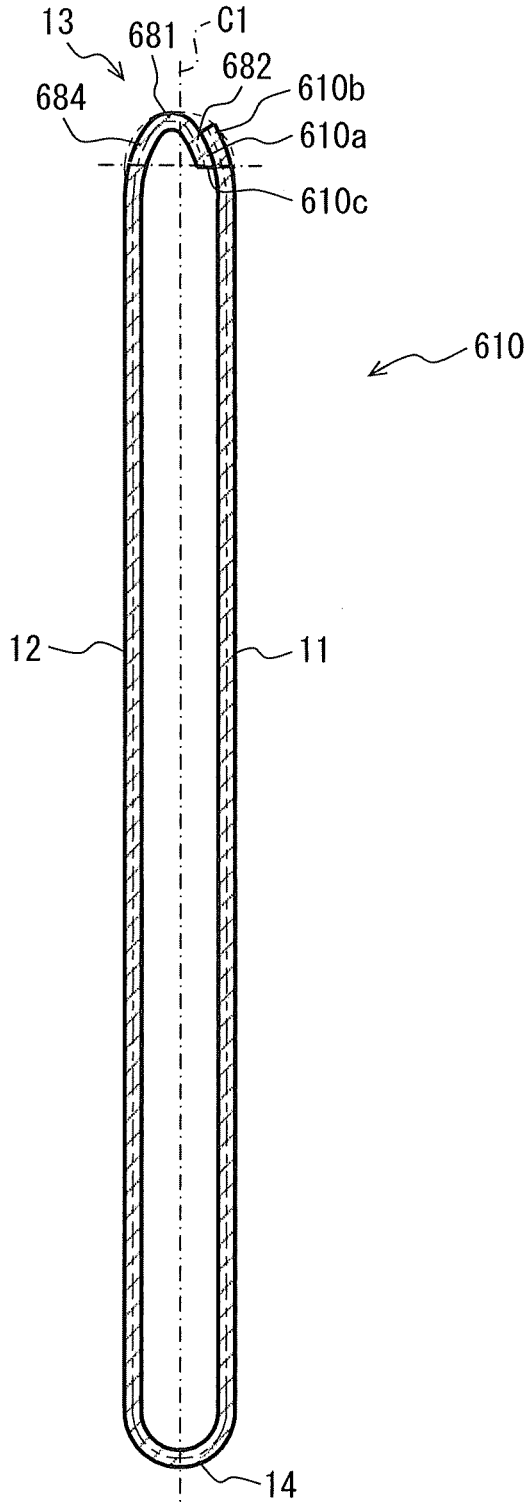
FIG. 14 is a sectional view of the flat tube according to a sixth embodiment of the invention.

Referring to FIG. 14, a sixth embodiment is explained. A rim 610*a* of a flat tube 610 has a large curvature region 681 that has a curvature radius smaller that a half of the thickness of the flat tube 610. The large curvature region 681 may be called as a first region. The radius of the large curvature region 681 is a half of a difference between the thickness of the flat tube 410 and the thickness of the metal plate 20. The rim 610*a* has a small curvature region 682 that has a curvature radius larger than a half of the thickness of the flat tube 610. The small curvature region 682 may be called as a second region. The large curvature region 681 is formed on a part of the rim 10*a* that is close to the center line C1. The small curvature region 682 is formed on a side close to a distal end, i.e., and end face 10*c* in comparison to the large curvature region 681. A rim 610*b* is placed on the small curvature region 682 of the rim 610*a*. The rim 610*b* may be placed on a side close to the distal end in comparison to the small curvature region 682. Further, a small curvature region 684 is formed on a side close to the flat plate portion 12 with respect to the large curvature region 681. The small curvature region 684 improves symmetry of the flat tube 100 with respect to the center line C1.

According to the embodiment, it is also possible to improve an outer profile of the flat tube 610, and even suppress a change of the outer profile.

(Seventh Embodiment)

Figure 15:
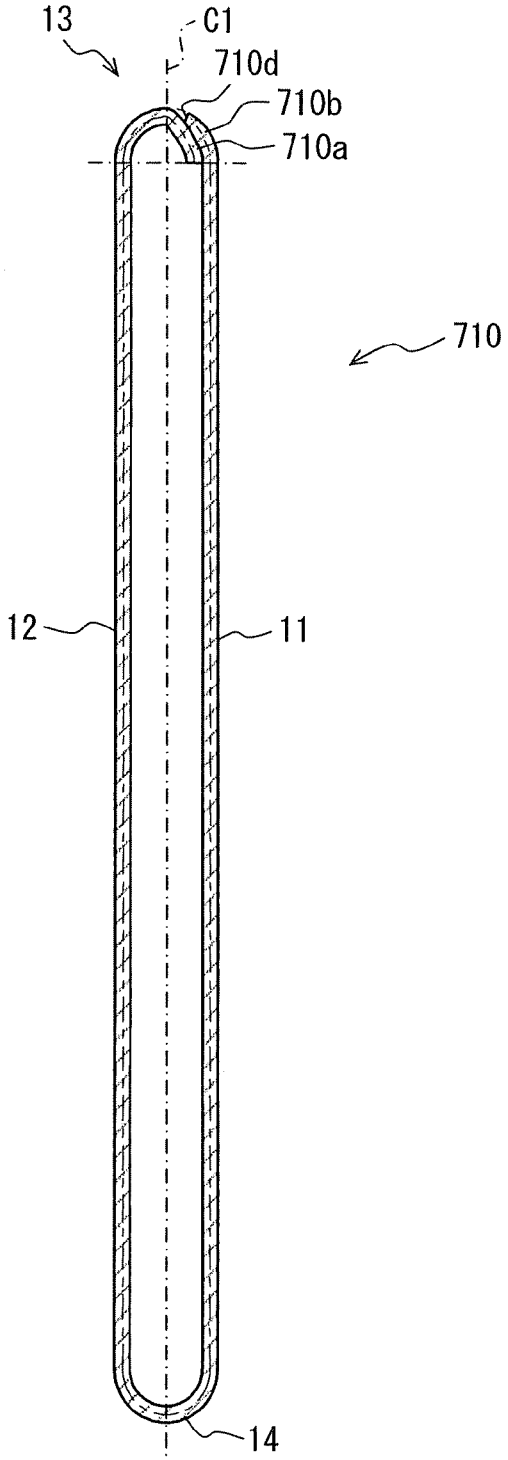
FIG. 15 is a sectional view of the flat tube according to a seventh embodiment of the invention.

Referring to FIG. 15, a seventh embodiment is explained. A flat tube 710 has a rim 710*b* that has a thickness gradually decreasing toward a side of a distal end, i.e., an end face 710*d*. As a result, it is possible to improve an outer profile of the flat tube 710.

(Eighth Embodiment)

Figure 16:
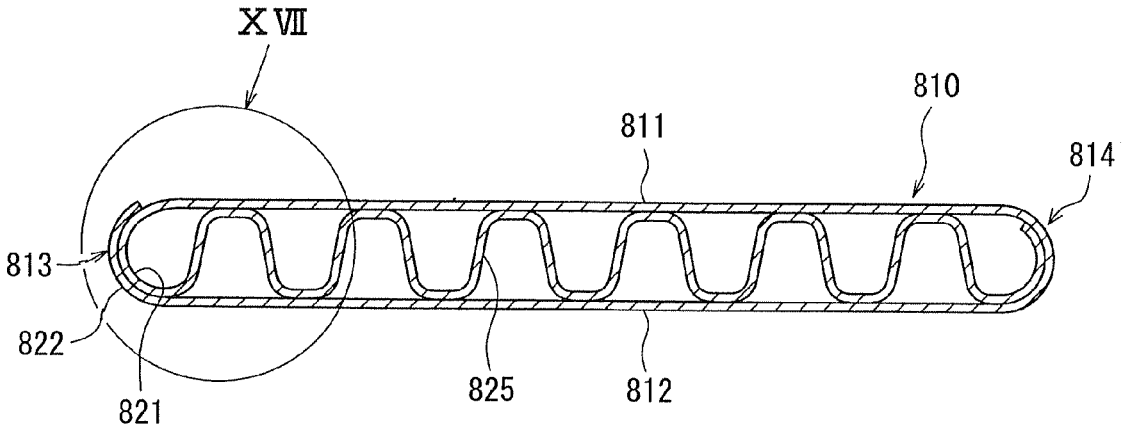
FIG. 16 is a sectional view of the flat tube according to a eighth embodiment of the invention.
Figure 17:
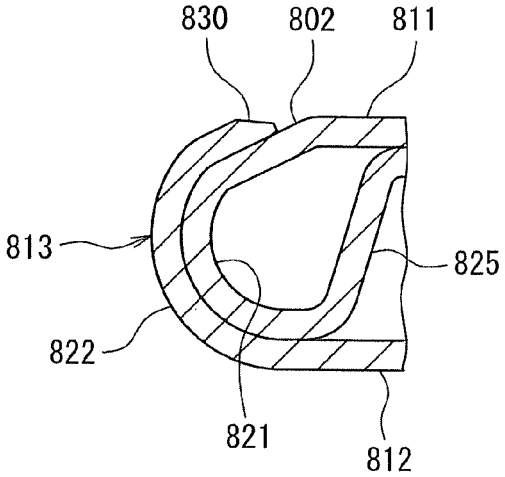
FIG. 17 is an enlarged sectional view of a portion XVII in FIG. 16.

Referring to FIGS. 16 and 17, an eighth embodiment is explained. The flat tube 810 is a tube with an inner fin. The flat tube 810 has a cylindrical member 820 providing an outer shell and a corrugate shape inner fin 825 disposed in the cylindrical member 20. The cylindrical member 820 has a cross sectional shape similar to the elliptical shape and provides a fluid passage therein. The cylindrical member 820 has a first flat plate portion 811 and a second flat plate portion 812 disposed on a shorter diameter direction to face and in parallel to each other. The cylindrical member 820 has a first semi-circular curved portion 813 and a second semi-circular curved portion 814 formed on a longer diameter direction to convex outwardly and to be formed in a substantially semi-circular shape. The inner fin 825 increases a heat exchanging surface area. The inner fin 825 has both ends that are closely contact along an inside surface of the first semi-circular curved portion 813 and the second semi-circular curved portion 814. Further, the remaining part of the inner fin 825 is formed in a corrugated shape, and comes in contact with the first flat plate portion 811 and the second flat plate portion 812. The cylindrical member 820 and the inner fin 825 are formed by a continuous belt shaped material. The cylindrical member 820 forms a closed cylinder by overlapping two rims at one end in the longer diameter direction. In this embodiment, a boundary region between the cylindrical member 820 and the inner fin 825 provides one of rim 821.

An outer rim 822 is placed to overlap on an outside of an inner rim 821. A part of the inner rim 821 has a flat region 802 that is inclined with respect to the longer diameter direction of the flat tube 810. The flat region 802 may be replaced with a small curvature region, but the flat region 802 provides advantages caused by its shape. The flat region 802 is placed close to the first flat plate portion 811. A distal end of the outer rim 822 is placed in the flat region 802. A distal end region of the outer rim 822 is formed in a flat plate shape along the flat region. The flat region 802 is placed inside the distal end of the outer rim 822. A distal end region of the outer rim 822 is formed as a thin plate portion 830 where a thickness is gradually decreased. The thin plate portion 830 is formed by an outside slant surface.

The flat region 802 suppresses an outwardly protruding amount of the distal end of the outer rim 822. Further, the thin plate portion 830 also suppresses an outwardly protruding amount of the distal end of the outer rim 822. The position of the distal end of the outer rim 822 may be shifted due to an error or the like in a manufacturing process. In order to keep the distal end on the flat region 802, a circumferential width of the flat region 802 is set taking a possible shift range of the distal end in consideration.

Figure 18:
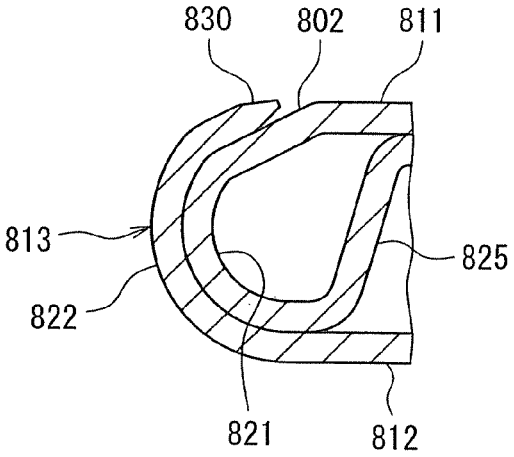
FIG. 18 is an enlarged sectional view of a modified one of the eighth embodiment.
Figure 19:
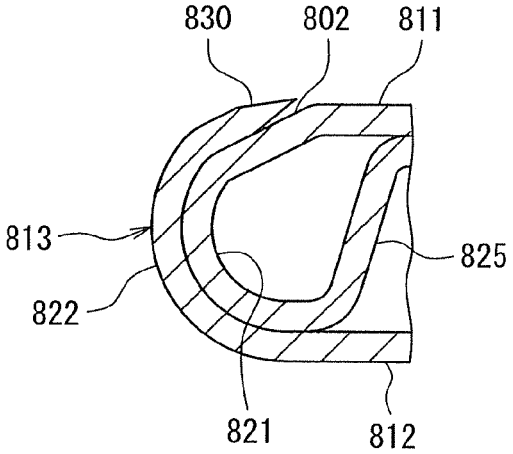
FIG. 19 is an enlarged sectional view of a modified one of the eighth embodiment.
Figure 20:
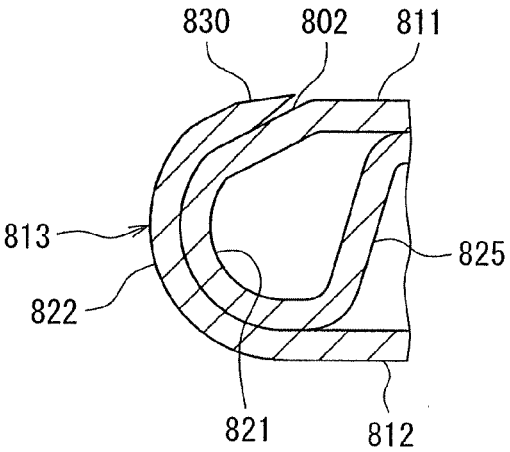
FIG. 20 is an enlarged sectional view of a modified one of the eighth embodiment.
Figure 21:
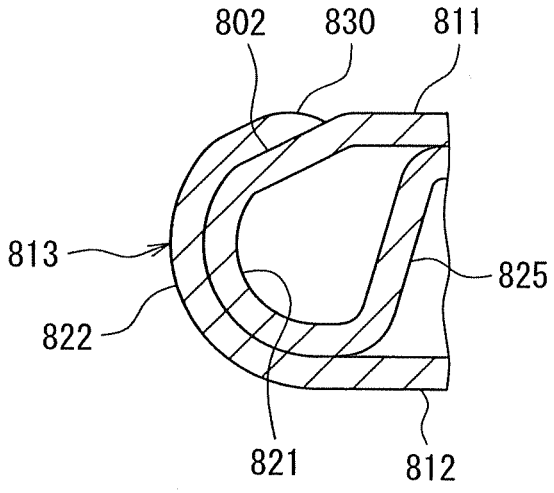
FIG. 21 is an enlarged sectional view of a modified one of the eighth embodiment.
Figure 22:
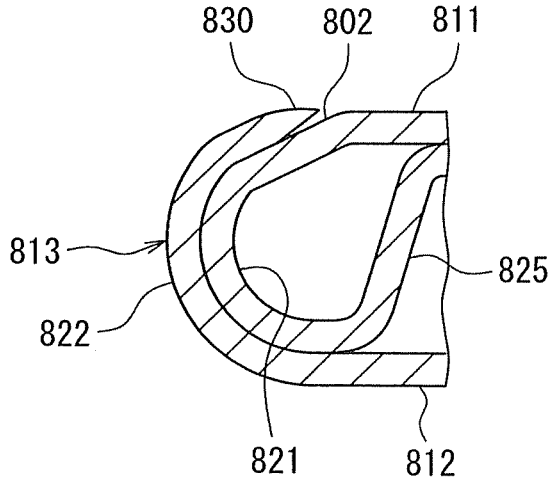
FIG. 22 is an enlarged sectional view of a modified one of the eighth embodiment.

Referring to FIG. 18 to FIG. 22, modified examples of the eighth embodiment are explained. FIGS. 18 to 22 show modified examples of the eighth embodiment. As shown in FIG. 18, inclined surfaces may be formed on both sides of a distal end region of the outer rim 822. In this case, the thin plate portion 830 is provided by a cross sectional shape that may be called as a both side tapered shape or a trapezoidal shape. As shown in FIG. 19, the thin plate portion 830 may be provided by a triangular cross sectional shape. The thin plate portion 830 may be provided by a curved surface formed on a distal end region of the outer rim 822. FIGS. 20 to 21 show the thin plate portion 830 defined with the curved surface.

(Other Embodiment)

In the above embodiments, examples have the end face 22*a* of the outer rim 22 placed on the small curvature region 102 of the inner rim 21 at both the pipe portion 17 and the flared portions 15 and 16. However, the end face 22*a* of the outer rim 22 may be placed on the large curvature region 103 of the inner rim 21 at the flared portions 15 and 16.

In the above embodiments, the present invention is applied to the radiator 1 that is categorized in a vertical flow type radiator having the flat tubes 10 extending in a vertical direction. However, the present invention may be applied to any type of radiators such as a horizontal flow type radiator that has flat tubes extending in a horizontal direction.

The invention claimed is:

1. A heat exchanger having a flat tube made of a metal plate that has an overlapped curved portion on an end in a cross section, wherein the flat tube comprises:

a first planar wall and a second planar wall defining a thickness of the flat tube, a center plane of the flat tube being defined midway between the first and second planar walls, the center plane extending in a direction parallel to the first and second planar walls;

an inner rim placed inside of an outer rim;

the outer rim placed on an outside of the inner rim;

a small radius region formed on the inner rim;

a large radius region formed on the inner rim having a larger radius than the small radius region; wherein an end face of the outer rim is placed on the large radius region at an approximate mid-point of the large radius region of the inner rim;

a thickness of the outer rim is equal to a thickness of the inner rim at an intersection with the center plane;

a thickness of the outer rim becoming thinner from a first point located between the intersection with the center plane and an end face of the outer rim to a second point located at the end face of the outer rim; and the first point on the outer rim and an end face of the inner rim are located on opposite sides of the center plane.

2. The heat exchanger claimed in claim 1, wherein the small radius region and the large radius region are curved without inverting of curving direction from a flat plate portion of the flat tube.

3. The heat exchanger claimed in claim 2, wherein the large radius region is a flat surface.

4. The heat exchanger claimed in claim 1, wherein the small radius region is placed closer to the distal end of the inner rim than the large radius region.

5. The heat exchanger claimed in claim 1, wherein the large radius region is placed closer to the distal end of the inner rim than the small radius region.

6. The heat exchanger claimed in claim 1, wherein the inner rim and the outer rim are overlapped in an angular range equal to or more than 45 degrees, wherein the large radius region is formed on a place that is not beyond a center line in a thickness direction of the flat tube, and wherein the outer rim extends beyond the center line.

7. The heat exchanger claimed in claim 6, further comprising:

a pair of headers having insertion holes for being inserted both the longitudinal ends of the flat tube therein, wherein the flat tube is made of the metal plate bent in a single direction, and has a pair of flat plate portions and a pair of curved portions, wherein the flat tube has a flared portion that is flared around the insertion hole, and wherein the large radius region is slanted with respect to the flat plate portion and has a radius larger than a difference between a half of the thickness of the flat tube and a thickness of the outer rim.

8. The heat exchanger claimed in claim 7, wherein the insertion hole has an opening shape that includes a semi-circular shape part corresponding to one of the radius portions.

9. The heat exchanger claimed in claim 1, wherein the inner rim extends beyond a center line in a thickness direction of the flat tube.

10. The heat exchanger claimed in claim 1, wherein the thickness of the inner rim is gradually decreased toward the end face of the inner rim.

11. The heat exchanger claimed in claim 1, wherein the end face of the outer rim and the outside surface of the inner rim define a facing angle in an acute angle.

12. The heat exchanger claimed in claim 1, wherein the metal plate is made of a clad plate having a brazing material layer clad on at least one of sides.

13. The heat exchanger claimed in claim 1, wherein an end face of the inner rim is disposed immediately adjacent a flat portion of the outer rim.

14. The heat exchanger claimed in claim 1, wherein the end face of the outer rim is placed at the middle of the large radius region of the inner rim over the entire length of the flat tube in a longitudinal direction of the flat tube.

15. A heat exchanger having a flat tube made of a metal plate that has an overlapped curved portion on an end in a cross section, wherein the overlapped curved portion of the flat tube comprises:

a first planar wall and a second planar wall defining a thickness of the flat tube, a center plane of the flat tube being defined midway between the first and second planar walls, the center plane extending in a direction parallel to the first and second planar walls;

an inner rim placed inside of an outer rim;

the outer rim placed on an outside of the inner rim;

a small radius region formed on the inner rim;

a large radius region formed on the inner rim having a larger radius than the small radius region, the small radius region and the large radius region being the only radius regions on the inner rim in the overlapped curved portion of the flat tube; wherein an end face of the outer rim is placed on the large radius region a thickness of the outer rim is equal to a thickness of the inner rim at an intersection with the center plane;

a thickness of the outer rim becoming thinner from a first point located between the intersection with the center plane and an end face of the outer rim to a second point located at the end face of the outer rim; and the first point on the outer rim and an end face of the inner rim are located on opposite sides of the center plane.

16. The heat exchanger claimed in claim 1, wherein:

both the first point of the outer rim and the end face of the outer rim are placed on the large radius region of the inner rim;

the large radius region of the inner rim and the end face of the inner rim are placed on opposite sides of the center plane of the flat tube in the thickness direction of the flat tube; and the small radius region of the inner rim is placed between the end face of the inner rim and the large radius region of the inner rim.

* * * * *